US005186720A

United States Patent [19]

Feustel et al.

[11] Patent Number: 5,186,720

[45] Date of Patent: Feb. 16, 1993

[54] USE OF PRODUCTS OF THE REACTION OF ALKENYL-SPIRO-BISLACTONES WITH AMINES AS PARAFFIN-DISPERSANTS

[75] Inventors: Michael Feustel, Kelkheim, Fed. Rep. of Germany; Werner Ritschel, deceased, late of Königstein, Fed. Rep. of Germany, by Maria A. Ritschel, née Breunig, heir

[73] Assignee: Hoechst Aktiengesellschaft, Frankfurt am Main, Fed. Rep. of Germany

[21] Appl. No.: 567,966

[22] Filed: Aug. 15, 1990

[30] Foreign Application Priority Data

Aug. 16, 1989 [DE] Fed. Rep. of Germany ..... 3926992

[51] Int. Cl.[5] ..... C10L 1/18; C10L 1/22

[52] U.S. Cl. ..... 44/351; 44/340; 44/352; 44/386

[58] Field of Search ..... 44/351, 352; 549/265

[56] References Cited

U.S. PATENT DOCUMENTS

| | | | |
|---|---|---|---|
| 2,321,311 | 6/1943 | Mottlau et al. | 44/352 |
| 3,048,479 | 8/1962 | Ilnyckyj | 44/62 |
| 3,248,187 | 4/1966 | Bell, Jr. | 44/351 |
| 3,961,916 | 6/1976 | Ilnyckyj et al. | 44/62 |
| 4,251,232 | 2/1981 | Brois et al. | 44/351 |
| 4,532,058 | 7/1985 | Chafetz | 252/51.5 A |

FOREIGN PATENT DOCUMENTS

| | | | |
|---|---|---|---|
| 634011 | 1/1962 | Canada | 44/351 |
| 0203812 | 12/1986 | European Pat. Off. . | |
| 0261959 | 3/1988 | European Pat. Off. . | |
| 0272889 | 6/1988 | European Pat. Off. . | |
| 1263152 | 2/1972 | United Kingdom . | |

*Primary Examiner*—Ellen McAvoy
*Attorney, Agent, or Firm*—Connolly and Hutz

[57] ABSTRACT

The use of products of the reaction of alkenyl-spirobislactones of the formula in which R is in each case $C_8$–$C_{200}$-alkenyl, with amines of the formula $NR^1R^2R^3$ in which $R^1$, $R^2$ and $R^3$ may be identical or different and at least one of these groups $R^1$, $R^2$ or $R^3$ is $C_8$–$C_{36}$-alkyl, $C_8$–$C_{36}$-alkenyl or cyclohexyl and the other groups are hydrogen or a group of the formula $—(A—O)_xH$ or $—(CH_2)_n—NYZ$, A is $—C_2H_4—$ and/or $—C_3H_6—$, x is a number from 1 to 20, n is 2 or 3 and Y and Z may be identical or different and are hydrogen or a group of the formula $(—A—O)_xH$, as paraffin-dispersants in middle distillates and crude oil.

15 Claims, 1 Drawing Sheet

USE OF PRODUCTS OF THE REACTION OF ALKENYL-SPIRO-BISLACTONES WITH AMINES AS PARAFFIN-DISPERSANTS

DESCRIPTION

The use of products of the reaction of alkenyl-spirobislactones with amines as paraffin-dispersants As a rule, mineral oil middle distillates from various sources have very different n-paraffin contents. In diesel fuel, long-chain paraffins ($C_{11}$–$C_{33}$) are advantageous on the one hand since they help to improve the cetane number, but on the other hand have the disadvantage that they reduce the fluidity of the fuel as the temperature falls.

This reduction of the flowability is due to the crystallization of the paraffins to give platelet-like crystals and also to the formation of a three-dimensional network structure (gel structure). During the operation of diesel engines or of heating installations at low temperatures, these crystals usually do not pass through the particular filtering equipment and therefore, sooner or later, cause a blockage of the fuel flow. This can be observed in starting or running difficulties in the diesel engine, or can lead to a failure of the fuel preheating system.

It is known that numerous additives can improve the cold flow or filterability. For instance, U.S. Pat. No. 3,961,916 describes the use of a mixture of copolymers to control the size of the paraffin crystals and according to GB-B-1,263,152, the size of the paraffin crystals can be controlled by the use of a copolymer having a low degree of chain branching. Furthermore, U.S. Pat. No. 3,048,479 describes the use of copolymers of ethylene and $C_1$–$C_5$-vinyl esters (for example vinyl acetate) as flow improvers for fuels such as diesel oil and heating oil.

The improvement in the cold flow which is achieved by incorporating (cocrystallizing) these known additives during paraffin crystal growth is due to a modification of the size and shape of the paraffin crystals formed, so that they no longer block the pores of the filters but form a porous filter cake and allow a more or less unimpeded passage of the remaining liquid components.

However, most of these flow improvers are not capable of preventing the settling of the paraffin crystals once they have been formed. The paraffin crystals have a slightly higher density than that of the surrounding fuel and therefore normally settle according to Stokes' Law. Since the tendency to settle also depends on the crystal size and on the crystal shape, a reduction of the crystal size to within the colloidal range is expected to significantly delay the settling of the paraffin crystals.

This very principle has been employed in a number of relatively recent patent specifications. For instance, EP-0,203,812 and 0,272,889 describe substances having a wax-antisettling action, i.e. once they have been formed, the paraffin crystals are supposed to remain homogeneously distributed in the middle distillate and not to settle.

The products employed are usually multi-component mixtures composed, for example, of tallow-fatty aminephthalic anhydride reaction products, alkyl diphenyl ethers, alkylnaphthalenes and small proportions of a flow improver. DE-A-3,634,082, 3,634,083 and EP-0,261,959 also describe the use of products of the reaction of the anhydride of orthosulfobenzoic acid with alkylamines as paraffin-dispersants.

However, practical tests have shown that although the described components have an adequate effect with many middle distillates, they fail with some diesel oils.

There is therefore still a need for very widely applicable, very effective paraffin-dispersants for middle distillates.

Surprisingly, it has now been found that certain products of the reaction of alkenyl-spirobislactones with certain amines are very effective paraffin-dispersants with many middle distillates, even at temperatures of below −20° C.

The present invention accordingly provides the use of products of the reaction of alkenyl-spirobislactones of the formula

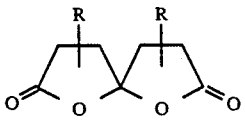

in which R is in each case a $C_8$–$C_{200}$-, preferably $C_{10}$–$C_{20}$-alkenyl, with amines of the formula $$NR^1R^2R^3$$

in which $R^1$, $R^2$ and $R^3$ may be identical or different and at least one of these groups $R^1$, $R^2$ or $R^3$ is $C_8$–$C_{36}$-alkyl, $C_8$–$C_{36}$-alkenyl or cyclohexyl and the other groups are hydrogen or a group of the formula $—(A—O)_xH$ or $—(CH_2)_n—NYZ$, A is $—C_2H_4—$ and/or $—C_3H_5—$, x is a number from 1 to 20, n is 2 or 3 and Y and Z may be identical or different and are hydrogen or a group of the formula $(—A—O)_xH$, as paraffin-dispersants in middle distillates and crude oil.

The alkenyl-spirobislactones used as starting compounds are prepared according to the process described in U.S. Pat. No. 4,532,058 by decarboxylation of alkenylsuccinic anhydrides in the presence of bases.

These alkenyl-spirobislactones are reacted with the amines of the given formula to give the products which are to be used according to the invention. This reaction can be carried out either in the absence of a solvent or in the presence of an inert, non-polar organic solvent.

The alkenyl-spirobislactones can be reacted either with a certain amine having the abovementioned radicals or else with mixtures of various amines simultaneously. The molar ratio of alkenyl-spirobislactone to amines is in the range of from 1:1 to 1:2.5, preferably 1:2, and the reaction temperatures are 60°–200° C., preferably 80°–120° C.

The reaction products which have been described above are suitable as paraffin-dispersants preferably in middle distillates such as diesel fuels or motor oils, but also in crude oils. They are usually used in amounts of from 150 to 500 ppm. Preferably, these paraffin-dispersants are not added alone but in combination with customary, known flow improvers, for example ethylene-vinyl acetate copolymers. The added amounts of flow improvers of this type are usually 50 to 600, preferably 300 ppm.

BRIEF DESCRIPTION OF THE DRAWING

The Drawing shows a 72-hour temperature profile used to test the dispersant action of various paraffin-dispersant additives.

GENERAL DATA FOR THE PREPARATION OF ALKENYL-SPIROBISLACTONES 2 mol of an alkenylsuccinic anhydride are heated in the presence of 0.5% by weight of KF for 6 hours at 220°-230° C., $CO_2$ being evolved. This gives 1 mol of the alkenyl-spirobislactone.

EXAMPLE 1

Figure 1:
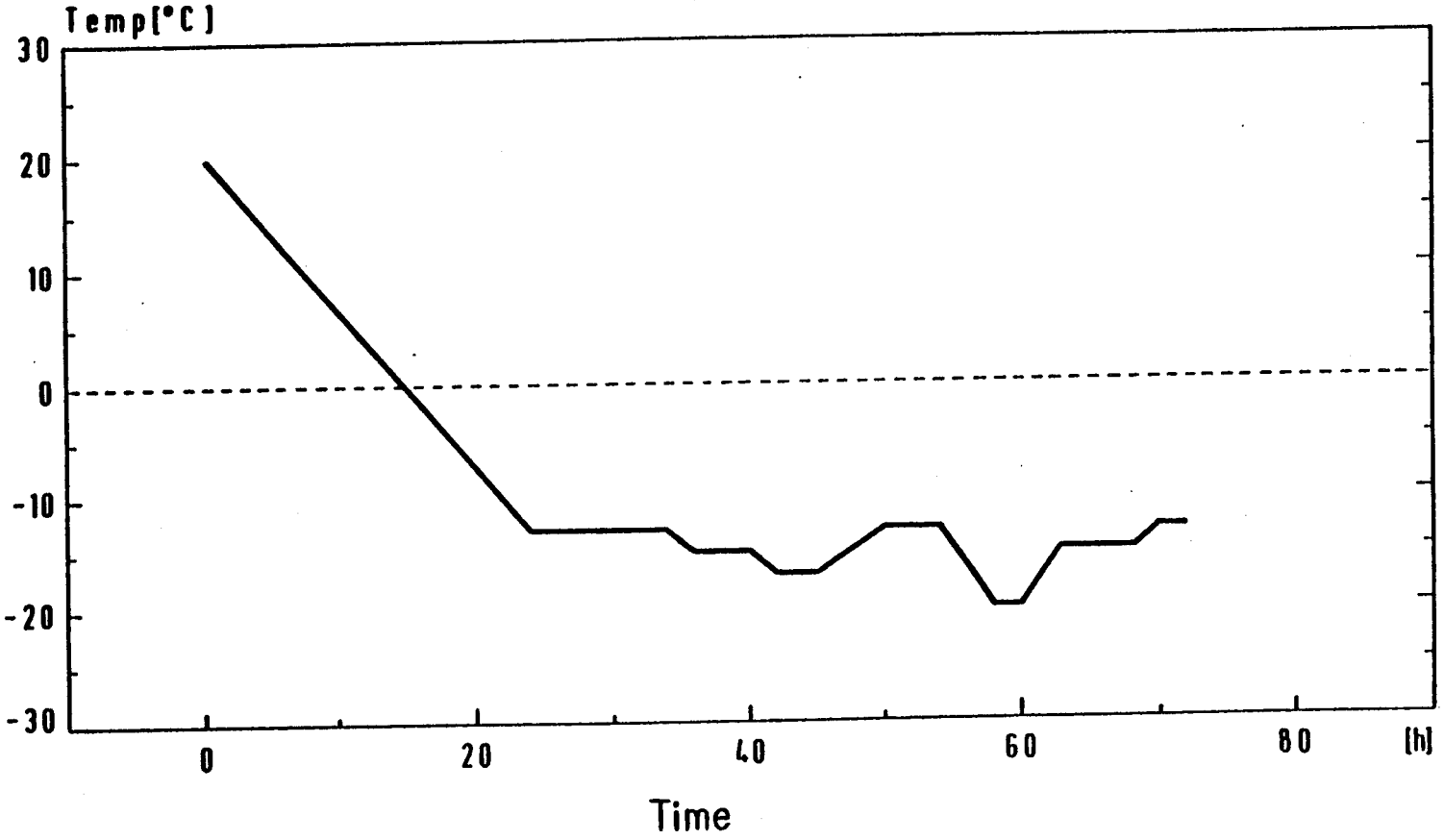

Reaction of dodecenyl-spirobislactone with tallow-fatty amine and di-tallow-fatty amine.

488 g (1 mol) of dodecenyl-spirobislactone are stirred at 80° C. for 2 hours with a mixture of 260 g (1 mol) of tallow-fatty amine and 495 g (1 mol) of di-tallow-fatty amine. Then 840 g of Shellsol AB (aromatic hydrocarbon mixture) are added, the mixture is stirred for 20 min and decanted. This gives about 2080 g of a brown oil having an active ingredient content of 60%.

EXAMPLE 2

Reaction of tetradecenyl-spirobislactone with tallow-fatty alkyldihydroxyethylamine and di-tallow-fatty amine 544 g (1 mol) of tetradecenyl-spirobislactone are first reacted with 360 g (1 mol) of tallow-fatty alkyl-dihydroxyethylamine for 1 hour at 120° C. and then 495 g (1 mol) of di-tallow-fatty amine are added and the mixture is stirred for a further 2 hours at 80° C. Then 930 g of Shellsol AB are added, the mixture is stirred for 20 min, and decanted. This gives about 2330 g of a brown oil having an active ingredient content of 60%.

EXAMPLE 3

The reaction of polyisobutenyl-spirobislactone with tallow-fatty propylenediamine and dicyclohexylamine 756 g (1 mol) of polyisobutenyl-spirobislactone ($R=C_{20}H_{39}$-$C_{24}H_{47}$) (this having been prepared by decarboxylation of 2 mol of polyisobutenylsuccinic anhydride having an average molecular weight of 400) is stirred with a mixture of 518 g (1.5 mol) of tallow-fatty propylenediamine and 363 g (0.5 mol) of dicyclohexylamine for 2 hours at 100° C. Then 1090 g of Shellsol AB are added, and the mixture is subsequently stirred for 20 min and decanted. This gives about 2700 g of a brown oil having an active ingredient content of 60%.

PERFORMANCE

In contrast to the determination of the filterability limit (CFPP, IP 309/DIN 51 428) there is so far no similarly standardized procedure for testing paraffin-dispersant action.

Besides a purely optical assessment of the degree of settling, microscopic investigations of the crystal size and analytical methods (DSC etc.) are used.

Since the settling rate can be considered as a function of the crystal size and this again is affected by the cooling rate, the CFPP test is excluded as a criterion for assessing the effectiveness of a paraffin-dispersant, the cooling rate of the oil sample being too high.

It is well known that rapid cooling gives a large number of small paraffin crystals while on the other hand slow cooling gives a considerably lower number of paraffin crystals and thus—for the identical amount of paraffin —the crystals are significantly larger.

Utilization of this feature was attempted in the laboratory test procedures described below. Generally, three parameters are significant for the settling of paraffin crystals:

—crystal size/shape
—temperature
—time

A large number of preliminary tests showed that the dispersant action of various additives can be observed and compared with highly reproducible results using a 72-hour low-temperature test (temperature profile, see FIG. 1). All of the low-temperature tests were carried out in a programmable refrigerator supplied by Heraeus-Vötsch.

LOW-TEMPERATURE TEST CONDITIONS

Duration: 72 hours

TEMPERATURES

Initial: +20° C.
after 24 hr: −13° C.
from 24–72 hr: −13° to −20° C.
final: −13° C.
Cooling rate: 1°-2° C./hr.
Sample volume: 100 ml After completion of the low-temperature test, the first step is to optically (visually) assess the oil sample. In this assessment, the paraffin settling is characterized visually in a known manner by determining the WDI (Wax Dispersion Index).

$$WDI = \frac{V_{set}}{V_{tot}} \times 100$$

$H_{set}$=volume of settled proportion of the sample,
$V_{tot}$=volume of the overall sample.

An optimal dispersion of paraffin, recognizable from a homogeneously cloudy oil sample, is indicated by a WDI of 100. Values below 100 indicate paraffin settling accompanied by clarification (increased transparency) of the oil sample. Underlined WDI values indicate partial wax settling; in this case, a low value indicates favorable characteristics.

The optical characterization of the dispersant behavior is carried out by dividing the sample (vol.: 100 ml) in two. This is done by carefully removing (temp.: −13° C.) 50 ml of the oil sample using a pipette. In doing this, the pipette is dipped just below the surface and is moved downward as the sample volume falls. Both the 50 ml sample which has been removed and also the remaining 50 ml bottom phase are then measured for cloud point (CP) and CFPP. As expected in these measurements, virtually identical CP values from the two phases indicate an optimal dispersion of the paraffin crystals (WDI: 100) or a partial settling. In the case of a clearly observable paraffin settling (WDI below 100) CP differences of more than 10° C. (cf. Examples) are sometimes obtained; furthermore, it is clear that the CFPP results do not reflect the difference between good and poor dispersion nearly as clearly as the results for CP.

The results obtained from various oils are summarized in the tabulation which follows.

| TEST OIL 1 | |
|---|---|
| CP: | 9.0° C. |
| CFPP: | −15.0° C. |
| IBP: | 165.0° C. |
| (90–20)%: | 104.0° C. |
| (FBP - 90%): | 33.0° C. |
| FBP: | 351.0° C. |

-continued

| Additive | Dosage ppm | WDI | CP (°C.) top | CP (°C.) bottom | CFPP (°C.) top | CFPP (°C.) bottom |
|---|---|---|---|---|---|---|
| FI 1 | 300 | 10 | −13.5 | −1.5 | −27 | −20 |
| FI 1/PD A | 300/400 | 100 | −9.0 | −8.7 | −25 | −25 |
| FI 2/PD A | 300/400 | 5 | −10.0 | −6.0 | −26 | −24 |

TEST OIL 2

| | |
|---|---|
| CP: | −9.0° C. |
| CFPP: | −15.0° C. |
| IBP: | 179.9° C. |
| (90-20)%: | 100.0° C. |
| (FBP - 90%): | 28.0° C. |
| FBP: | 347.6° C. |

| Additive | Dosage ppm | WDI | CP (°C.) top | CP (°C.) bottom | CFPP (°C.) top | CFPP (°C.) bottom |
|---|---|---|---|---|---|---|
| FI 1 | 300 | 10 | −15.4 | −2.4 | −28 | −19 |
| FI 1/PD A | 300/300 | 100 | −8.3 | −8.0 | −27 | −27 |

TEST OIL 3

| | |
|---|---|
| CP: | −10.0° C. |
| CFPP: | −11.0° C. |
| IBP: | 162.2° C. |
| (90-20)%: | 103.0° C. |
| (FBP - 90%): | 37.7° C. |
| FBP: | 344.0° C. |

| Additive | Dosage ppm | WDI | CP (°C.) top | CP (°C.) bottom | CFPP (°C.) top | CFPP (°C.) bottom |
|---|---|---|---|---|---|---|
| FI 1 | 200 | 10 | −13.2 | −3.5 | −32 | −20 |
| FI 1/PD A | 200/300 | 2 | −9.8 | −9.0 | −33 | −30 |

TEST OIL 4

| | |
|---|---|
| CP: | −5.0° C. |
| CFPP: | −9.0° C. |
| IBP: | 178.3° C. |
| (90-20)%: | 104.6° C. |
| (FBP - 90%): | 29.0° C. |
| FBP: | 354.0° C. |

| Additive | Dosage ppm | WDI | CP (°C.) top | CP (°C.) bottom | CFPP (°C.) top | CFPP (°C.) bottom |
|---|---|---|---|---|---|---|
| FI 1 | 300 | 8 | −8.0 | −2.0 | −30 | −18 |
| FI 1/PD A | 300/400 | 100 | −4.5 | −4.3 | −28 | −28 |

TEST OIL 5

| | |
|---|---|
| CP: | −7.0° C. |
| CFPP: | −10.0° C. |
| IBP: | 164.3° C. |
| (90-20)%: | 112.4° C. |
| (FBP - 90%): | 35.6° C. |
| FBP: | 352.0° C. |

| Additive | Dosage ppm | WDI | CP (°C.) top | CP (°C.) bottom | CFPP (°C.) top | CFPP (°C.) bottom |
|---|---|---|---|---|---|---|
| FI 1 | 300 | 10 | −12.0 | −3.0 | −33 | −18 |
| FI 1/PD A | 300/400 | 100 | −6.9 | −7.1 | −30 | −29 |

TEST OIL 6

| | | |
|---|---|---|
| | CP: | −12.0° C. |
| | CFPP: | −15.0° C. |
| | IBP: | 171.4° C. |
| to which 900 ppm of flow improver have already been added, CFPP - 20° C. | (90-20)%: | 112.7° C. |
| | (FBP - 90%): | 44.0° C. |
| | FBP: | 359.4° C. |

| Additive | Dosage ppm | WDI | CP (°C.) top | CP (°C.) bottom | CFPP (°C.) top | CFPP (°C.) bottom |
|---|---|---|---|---|---|---|
| FI 1 | 200 | 10 | −16 | −8.0 | −35 | −20 |
| PD A | 400 | 100 | −11 | −10.5 | −37 | −38 |

The additives F 1 and F 2 mentioned in the test examples are flow improvers of the ethylene-vinyl acetate copolymer type (Dodiflow® 3744 and Dodiflow® 3905), and PDA represents the paraffin-dispersant according to Preparation Example 1 above.

CP: Cloud Point;

CFPP: Cold Filter Plugging Point;

IBP: Initial Boiling Point;

FBP: Final Boiling Point

We claim:

1. A process for improving the flowability of middle distillates and crude oil at low temperatures, which comprises adding to the middle distillates or crude oil a flow improving product of the reaction of the components comprising an alkenyl-spirobislactone of the formula

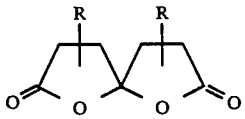

in which R is in each case $C_8$–$C_{200}$-alkenyl, with an amine of the formula $NR^1R^2R^3$ in which $R^1$, $R^2$ and $R^3$ are identical or different and at least one of these groups $R^1$, $R^2$ or $R^3$ is $C_8$–$C_{36}$-alkyl, $C_8$–$C_{36}$-alkenyl or cyclohexyl and the other groups are hydrogen or a group of the formula $—(A—O)_xH$ or $—(CH_2)_n—NYZ$, A is $—C_2H_4—$ and/or $—C_3H_5—$, x is a number from 1 to 20, n is 2 or 3 and Y and Z are identical or different and are hydrogen or a group of the formula $(—A—O)_xH$.

2. The process as claimed in claim 1, wherein a said product is added in an amount of from 50 to 600 ppm.

3. The process as claimed in claim 1, wherein a further flow-improving product is additionally added.

4. The process as claimed in claim 1, wherein a said product which is added is obtained by reacting alkenyl-spirobislactone and amine in the ratio of 1:1 to 1:2.5.

5. The process as claimed in claim 1, wherein a said product which is added is obtained by reacting alkenyl-spirobislactone and amine at 60° to 200° C.

6. The process as claimed in claim 1, wherein alkenyl-spirobislactones are used in which R is in each case $C_8$–$C_{20}$-alkenyl.

7. The process as claimed in claim 1, wherein alkenyl-spirobislactones are used in which R is in each case $C_8$–$C_{24}$-alkenyl.

8. The process as claimed in claim 1, wherein alkenyl-spirobislactones are used in which R is in each case $C_{10}$–$C_{20}$-alkenyl.

9. The process as claimed in claim 1, wherein said product which is added is obtained by reacting alkenyl-spirobislactone and amine at 80°–120° C.

10. The process as claimed in claim 1, wherein said product which is added is obtained by reacting alkenyl-spirobislactone and amine in the ratio of 1:2.

11. The process as claimed in claim 1, wherein a said product is added in an amount of 300 ppm.

12. A process as claimed in claim 1, wherein $R^1$, $R^2$ and $R^3$ may be identical or different and at least one of these groups $R^1$, $R^2$ or $R^3$ is $C_8$–$C_{36}$-alkyl or cyclohexyl and the other groups are hydrogen or a group of the formula $—(A—O)_xH$ or $—(CH_2)_n—NYZ$.

13. A process as claimed in claim 1, wherein $R^1$, $R^2$ and $R^3$ is $C_8$–$C_{36}$-alkyl, $C_8$–$C_{36}$-alkenyl or cyclohexyl and the other groups are hydrogen or a group of the formula $—(A—O)_xH$.

14. A mineral oil distillate containing 50 to 600 ppm of a flow-improving additive, said additive comprising a product of the reaction of the components comprising an alkenyl-spirobislactone of the formula

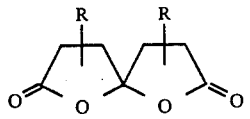

in which R is in each case $C_8$–$C_{200}$-alkenyl, with an amine of the formula $NR^1R^2R^3$ in which $R^1$, $R^2$ and $R^3$ are identical or different and at least one of these groups $R^1$, $R^2$ or $R^3$ is $C_8$–$C_{36}$-alkyl, $C_8$–$C_{36}$-alkenyl or cyclohexyl and the other groups are hydrogen or a group of the formula $—(A—O)_xH$ or $—(CH_2)_n—NYZ$, A is $—C_2H_4—$, $—C_3H_6—$ or combinations thereof, x is a number from 1 to 20, n is 2 or 3 and Y and Z are identical or different and are hydrogen or a group of the formula $(—A—O)_xH$.

15. A mineral oil middle distillate as claimed in claim 14, wherein the paraffin dispersant comprises a said product and an additional flow-improving additive.

* * * * *